United States Patent [19]

Davis

[11] 4,230,906

[45] Oct. 28, 1980

[54] SPEECH DIGITIZER

[75] Inventor: Charles R. Davis, Cupertino, Calif.

[73] Assignee: Time and Space Processing, Inc., Cupertino, Calif.

[21] Appl. No.: 909,479

[22] Filed: May 25, 1978

[51] Int. Cl.[2] ..... G10L 1/00

[52] U.S. Cl. ..... 179/1 SA; 179/1 SC

[58] Field of Search ..... 179/1 SA, 1 SC, 1 SM

[56] References Cited

U.S. PATENT DOCUMENTS

| | | | |
|---|---|---|---|
| 3,903,366 | 9/1975 | Coulter | 179/1 SA |
| 3,947,638 | 3/1976 | Blankenship | 179/1 SA |
| 4,058,676 | 11/1977 | Wilkes et al. | 179/1 SA |
| 4,074,069 | 2/1978 | Tokura | 179/1 SC |

OTHER PUBLICATIONS

L. Rabiner, et al., "A Comparative Study of Pitch Algorithms", IEEE Trans. Acoustics, Sp., Sig. Prod., Oct. 1976.

B. Gold, "Digital Speech Networks", Proc. IEEE, Dec. 1977.

*Primary Examiner*—Malcolm A. Morrison
*Assistant Examiner*—E. S. Kemeny
*Attorney, Agent, or Firm*—Flehr, Hohbach, Test

[57] ABSTRACT

A speech digitizer is disclosed including an analyzer for generating power and filter coefficient parameters representative of an analog speech waveform. The digitizer also includes a pitch detector for generating a digital pitch parameter substantially representing the fundamental periodicity of the waveform and including range restrictor means for restricting the pitch signal to a range of pitches within a predetermined tolerance if the average pitch of the periodicity signal is below a predetermined level. The pitch detector also includes means for determining the number of extreme maximum and minimum points within a predetermined range of an absolute magnitude difference function thereby generating a structure number signal representing a voiced event. The digitizer includes a voicing detector for generating a three-level voicing/unvoicing parameter representing whether the speech waveform is voiced or unvoiced.

14 Claims, 8 Drawing Figures

SPEECH DIGITIZER

BACKGROUND OF THE INVENTION

The present invention relates to a digital speech network and more particularly, to a speech digitizer for digitizing an analog speech waveform for transmission over a serial digital channel in a digital communication system.

In the prior art, digital speech networks accept an accoustic speech signal and convert or translate it into a serial digital data stream. Originally, such devices tended to be bulky, costly and unreliable. Progress in the development of speech algorithms, plus the advances in digital technology and digital signal processing techniques, have reduced size and cost and increased reliability to a point where beneficial widespread use of such devices can be confidently predicted.

Generally, a digital speech network comprises an analyzer which converts the audio signal into a digital format which can then be transmitted over a conventional digital telephone channel and a synthesizer which is responsive to the digital information in order to reconstruct the audio signal.

Problems occuring in the prior art are (1) correctly estimating the excitation parameters in speech analysis-synthesis systems in which it must be determined whether an excitation signal is voiced or voiceless (periodic or random) and (2) estimating the time varying voice fundamental frequency (pitch). Speech quality is critically dependent upon the successful estimation of these two parameters-voice and pitch.

If an analyzer incorrectly identifies a voiceless sound to be voice, the listener hears an unpleasant "buzziness" in the synthesized speech. If the analyzer incorrectly identifies a voice sound (or part of a voice sound) to be voiceless, the sound suddenly becomes harsh. Mistakes in estimating fundamental frequency of the voice cause comparable high intrusive unnatural sounds to appear to be incorporated into the perceived speech. These effects can be noticeable even when the analyzer is correct for a large percent of the time. In difficult environments in which the analyzer causes a large percentage of mistakes, the effect is to severely lower the overall intelligibility and quality of the speech communications.

Therefore, in view of the above background, it is an objective of the present invention to provide a speech digitizer having improved pitch detection and voicing detection capabilities.

SUMMARY OF THE INVENTION

The present invention relates to a speech digitizer for use in a communication system operating in a multiframe format.

The speech digitizer includes an analyzer connected to receive an analog speech waveform, where the analyzer includes power and filter coefficient means responsive to the speech waveform for generating in digital format variable filter coefficient and power parameters representative of the waveform. The analyzer also includes pitch detector means for generating a pitch parameter substantially representing the fundamental periodicity of the waveform and voice detector means for generating a voicing parameter representing whether the speech waveform is voiced or unvoiced.

Multiplexer means are included for multiplexing the parameters into a digital serial data stream in a multiframe format where selected ones of the frames occur as a synchronization frame. Synchronization means are included for providing a synchronization code whereby the multiplexer means multiplexes the synchronization code into a portion of the synchronization frame.

First signaling interface means are included for connecting signaling information to another portion of the synchronization frame and means are provided for transmitting the digital serial data stream.

The speech digitizer also includes a synthesizer connected to receive the transmitted digital serial stream for generating a second analog waveform representative of the first analog waveform. The synthesizer includes demultiplexer means for demultiplexing the transmitted parameters, the synchronization code and the signaling information. Second signaling interface means are provided to receive the demultiplexed transmitted signaling information.

The synthesizer also includes periodic generator means for generating a periodic component signal representative of a pitch pulse signal and aperiodic generator means for generating an aperiodic signal representative of a random noise signal. Mixer means are included connected to receive the component signals for mixing the component signals thereby forming a driving function signal and filter means are provided connected to receive the driving function signal for generating the second analog waveform thereby representing the first analog waveform.

In another embodiment, the pitch detector means include function means for generating a digital signal representing an absolute magnitude difference function where the digital signal includes a predetermined number of samples representing the variations in the pitch of the analog waveform and includes a pattern of recurring maximum and minimum points over the pitch range. A pitch detector also includes global minimum means for generating a first pitch signal representing the fundamental pitch of the sampled signal and multiple check means connected to receive the digital signal and the first pitch signal for generating a second pitch signal when one of the multiple signals is lower than the first pitch signal by interpolating over successive samples of the digital signal thereby generating a second pitch signal.

In another embodiment, the voicing detector means include means for generating the voice parameter in response to a determination of the presence of a strong voice signal, to a periodicity signal, to a weak voice and periodicity signal, and to a structure number signal. The structure number signal is generated by determining the number of extreme maximum and minimum points within a predetermined range of an absolute magnitude difference function of the waveform which represents a glottal point event when the number of extreme points is less than a predetermined number.

In accordance with the above summary, the present invention achieves the objective of providing an improved speech digitizer for use in a digital communication system.

Additional objects and features of the invention will appear from the following description in which the preferred embodiments of the invention have been set forth in detail in conjunction with the accompanying drawings.

DETAILED DESCRIPTION OF THE DRAWINGS

Figure 1:
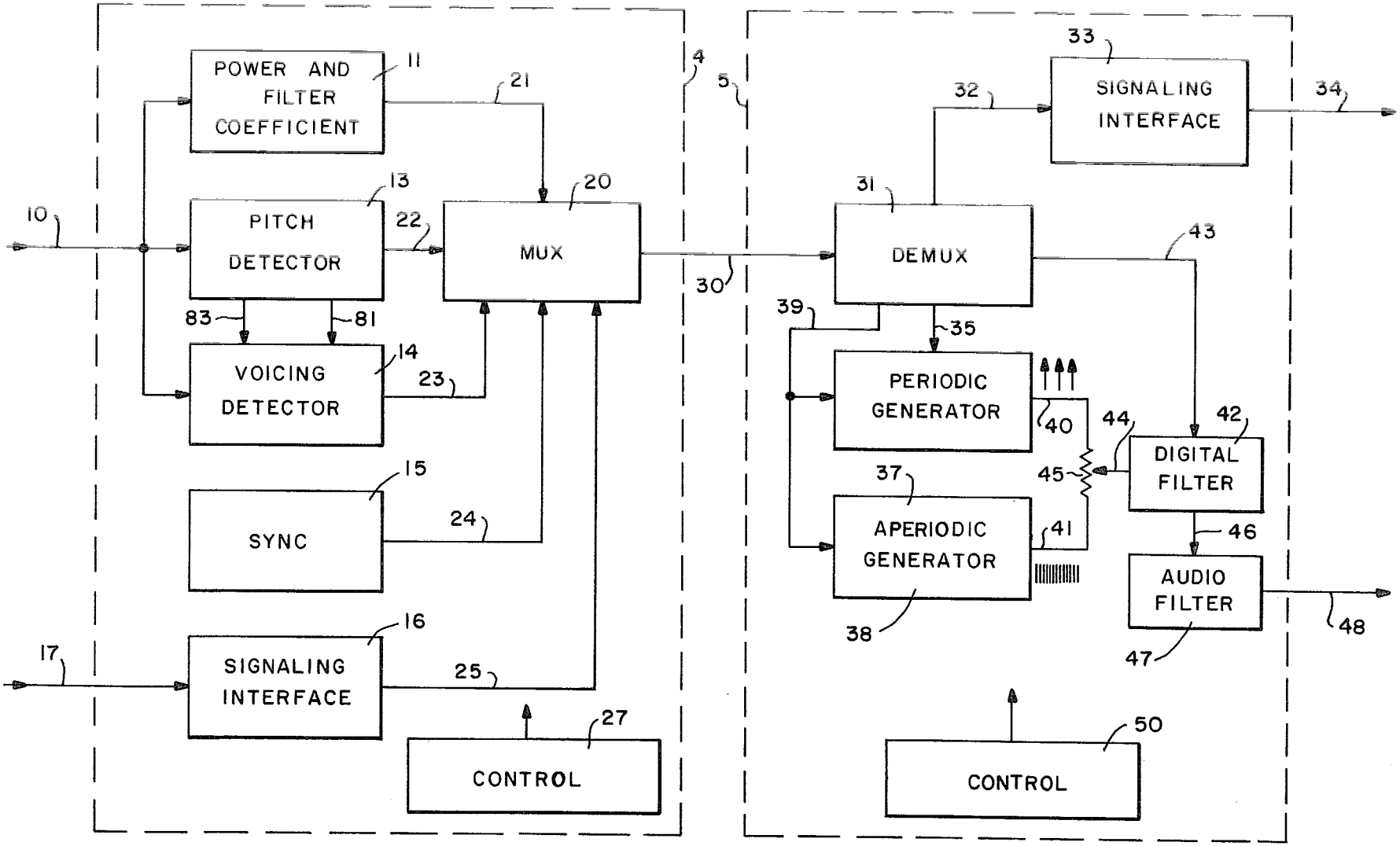
FIG. 1 depicts a block diagram for a speech digitizer according to the present invention.

Referring now to FIG. 1, there is depicted therein a block diagram of a speech digitizer according to the present invention, comprising an analyzer portion 4 and a synthesizer portion 5.

In FIG. 1, an analog speech signal or waveform is input on bus 10 into the analyzer portion 5 including power and filter coefficient circuit 11, speech detector 13 and voicing detector 14.

Power and filter coefficient circuit (PFC) 11 generates typical partial correlation coefficients (parcor) K1–K9 on bus 21 by utilizing a linear predictive coding (LPC) technique well known in the art.

Multiplexer 20 receives the power and filter coefficients on bus 21 and multiplexes them into a digital serial data stream on bus 30 together with other information as will be described.

The digital data stream on bus 30 operates in a multiframe format where a frame in one embodiment comprises 22½ milliseconds (ms). It has been found that analyzing an audio signal in recurring time frames of 22½ milliseconds provides sufficient resolution capabilities for digitizing the audio signal.

The serial data on bus 30 comprises 2400 bits per second of information or 54 bits per frame of 22½ milliseconds. The serial data includes a 7 bit pitch signal, coefficients K1–K9 with a total of 41 bits and a 6 bit power coefficient.

Figure 8:
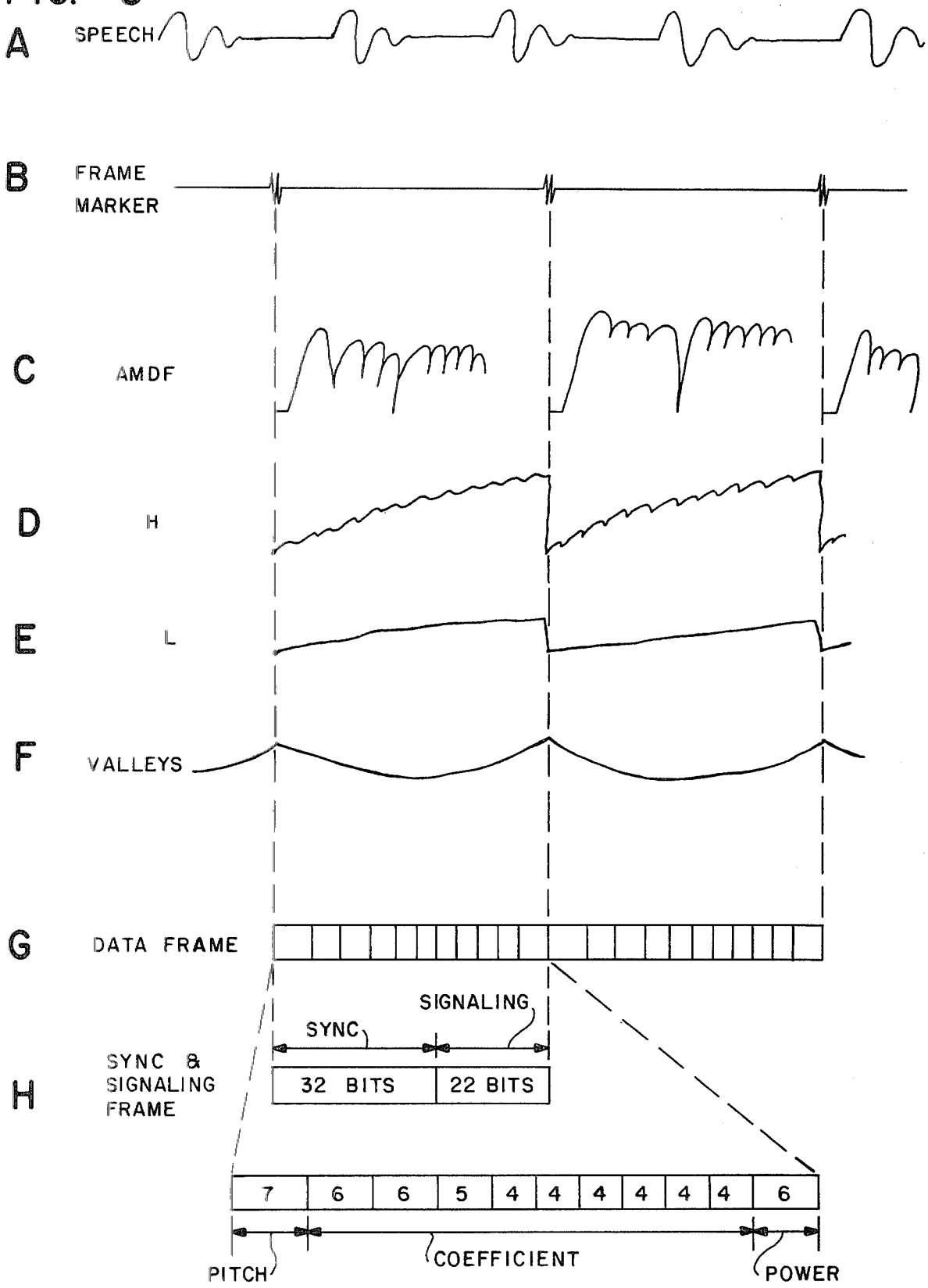
FIG. 8 depicts a timing diagram for describing the operation of FIG. 1.

The frame format is depicted in FIG. 8.

In the multiframe format, it is necessary to including a synchronization frame during the multiframe format to enable the speech digitizer system to ensure that data is being transmitted properly. The synchronization frame includes a predetermined 32 bit code which is transmitted every 2–4 seconds. The synchronization code is transmitted if a lapse in speech is detected after approximately 2 seconds. In the event that there is continuous speech, the synchronization code is transmitted approximately once every four seconds. The synchronization format is depicted in FIG. 8.

As the synchronization frame includes 32 bits of a predetermined code, there remains therein 22 bits which can be utilized for transmitting signaling information such as off-hook, on-hook, and dialing information.

In order to incorporate this feature, signalling information on bus 17 in FIG. 1 is connected to signalling interface 16 which connects the signalling information via bus 25 to multiplexer 20 which will appropriately multiplex the signalling information onto bus 30 into another portion of the synchronization frame at the appropriate time.

Synchronization of the multiframe format is provided by synchronization circuit 15 via bus 24 which through techniques well known in the art provides the necessary timing functions to multiplexer 20.

Control circuit 27 provides the necessary control signals to the PFC 11, pitch detector 13, voicing detector 14, sync circuit 15, signalling interface 16, and multiplexer 20. In a typical embodiment, the control circuit 27 could be a microprocessor such as Intel's 8080A, the operation of which is well known in the art.

The speech waveform on bus 10 is input to pitch detector 13 which generates an appropriate pitch signal on bus 22 and which is multiplexed at the appropriate time by multiplexer 20 onto serial bus 30. The pitch detector will be described in more detail in conjunction with FIGS. 2–6.

The speech waveform on bus 10 is also input to voicing detector 14 which provides a voicing/unvoicing function signal on bus 23 under control of pitch detector 13 via buses 83 and 81. The voicing detector will be described in more detail in conjunction with FIG. 7.

In FIG. 1, the serial digital data stream on bus 30 is transmitted to synthesizer portion 5. The demultiplexer circuit 31 receives the serial digital data stream on bus 30 and appropriately demultiplexes the information thereon.

During a synchronization frame, the transmitted signaling information is demultiplexed onto bus 32 and connected to a signaling interface 33 thereby providing dialing information or other information on bus 34.

Demultiplexer 31 provides amplitude or power control on bus 39 to control the amplitudes of periodic generator 37 and aperiodic generator 38.

Periodic generator 37 also receives the pitch detector signal on bus 35 from demultiplexer 31 which determines the rate at which a signal on bus 40 is generated.

Periodic generator 37 generates a periodic impulse signal on bus 40 while aperiodic generator 38 generates a random aperiodic signal on bus 41 by well known techniques.

The filter coefficients from analyzer portion 4 are demultiplexed onto bus 43 and input to a digital filter 42 using well known techniques. However, a driving function signal on bus 44 is generated by a relative mixing function which provides improved quality of the regenerated speech signal. The mixing function is provided by mixing circuit 45 and is determined by the voicing detector circuit 14.

The digital filter 42 is connected to audio filter 57 via bus 46 which provides the regenerated speech signal on bus 48.

Control of the synthesizer portion 5 of the speech digitizer is provided by control circuit 50, which again could be a typical microprocessor such as Intel's 8080A.

Figure 2:
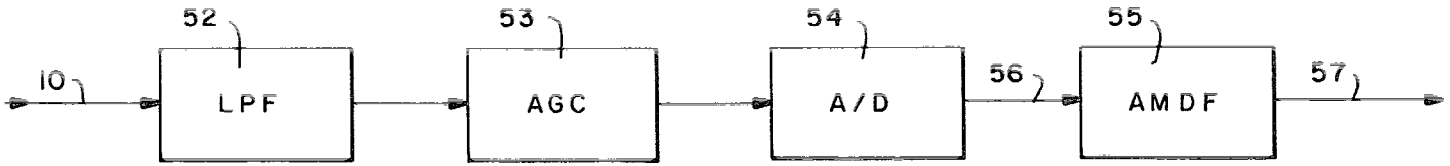
FIG. 2 depicts a block diagram of a portion of a pitch detector, which forms a portion of FIG. 1.

Referring now to FIG. 2, a portion of the pitch detector of FIG. 1 is depicted therein in which the speech waveform on bus 10 is input to a conventional low pass filter 52 which is connected to an automatic gain control (AGC) circuit 53. The AGC circuit serves to stabilize the waveform over which an absolute magnitude difference function is computed.

Figure 5:
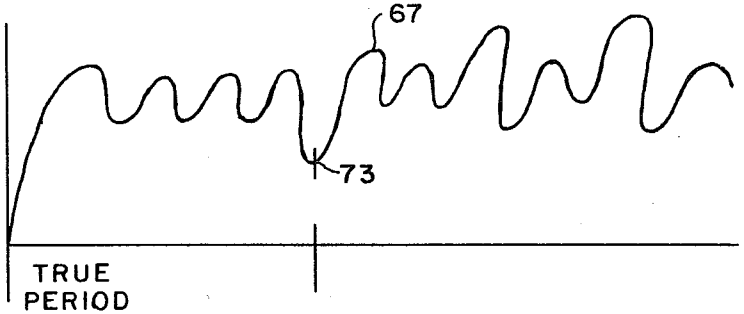
FIGS. 4 and 5 depict representative plots of AMDF functions.
Figure 4:
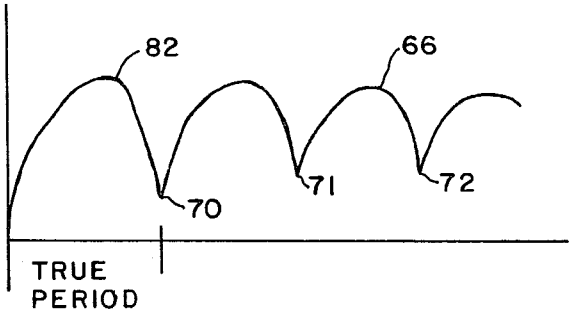

The stabilized signal is connected to analog to digital converter 54, which converts the data to a digital format on bus 56 to the absolute magnitude difference function (AMDF) circuit 55 which generates an AMDF signal on bus 57 and as depicted in FIGS. 4 and 5 by well known techniques.

Figure 3:
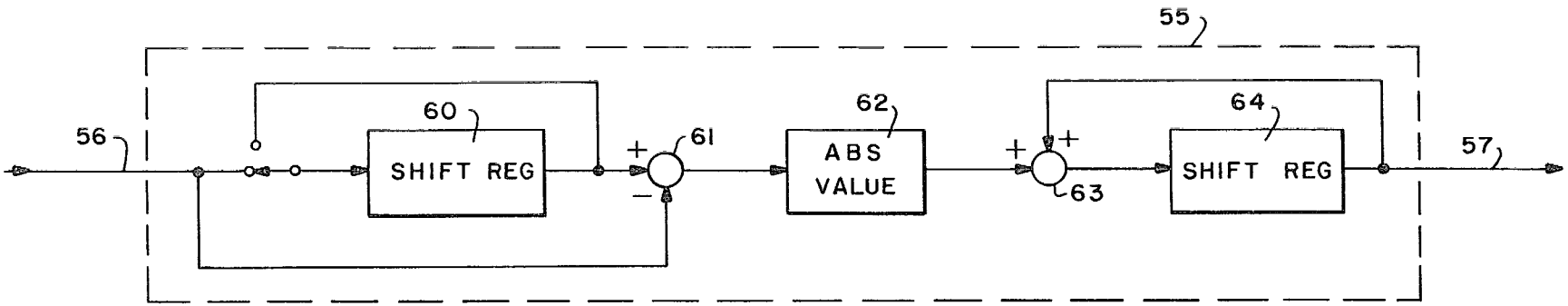
FIG. 3 depicts a block diagram of an absolute magnitude difference function algorithm, which forms a portion of FIG. 2.

In FIG. 3, there is depicted a block diagram of the AMDF circuit 55 of FIG. 2, which operates to process the signal on bus 56 to generate the AMDF signal on bus 57 as depicted in FIGS. 4 and 5. The AMDF algorithm is set forth below:

$$AMDF(i) = \sum_{j=1}^{N} |X_j - X_{j+i}|$$

Briefly, the data on bus 56 is input to shift register 60 where the iteration for the data is performed in adder 61 and the absolute value is tabulated by conventional circuit 62. The final summation is performed by adder 63 and shift register 64 to provide the AMDF function on bus 57. A total of 160 points are calculated for the AMDF function such as depicted in FIGS. 4 and 5. The respective AMDF functions 66, 67 represent varying amplitude in the form of recurring maxima and minima points. For example, waveform 66 comprises a series of minima points 70, 72 and a maximum point 82. The horizontal axis represents increasing pitch period and the left most minimum point 72 represents the time period or fundamental frequency of the speech signal.

Figure 6:
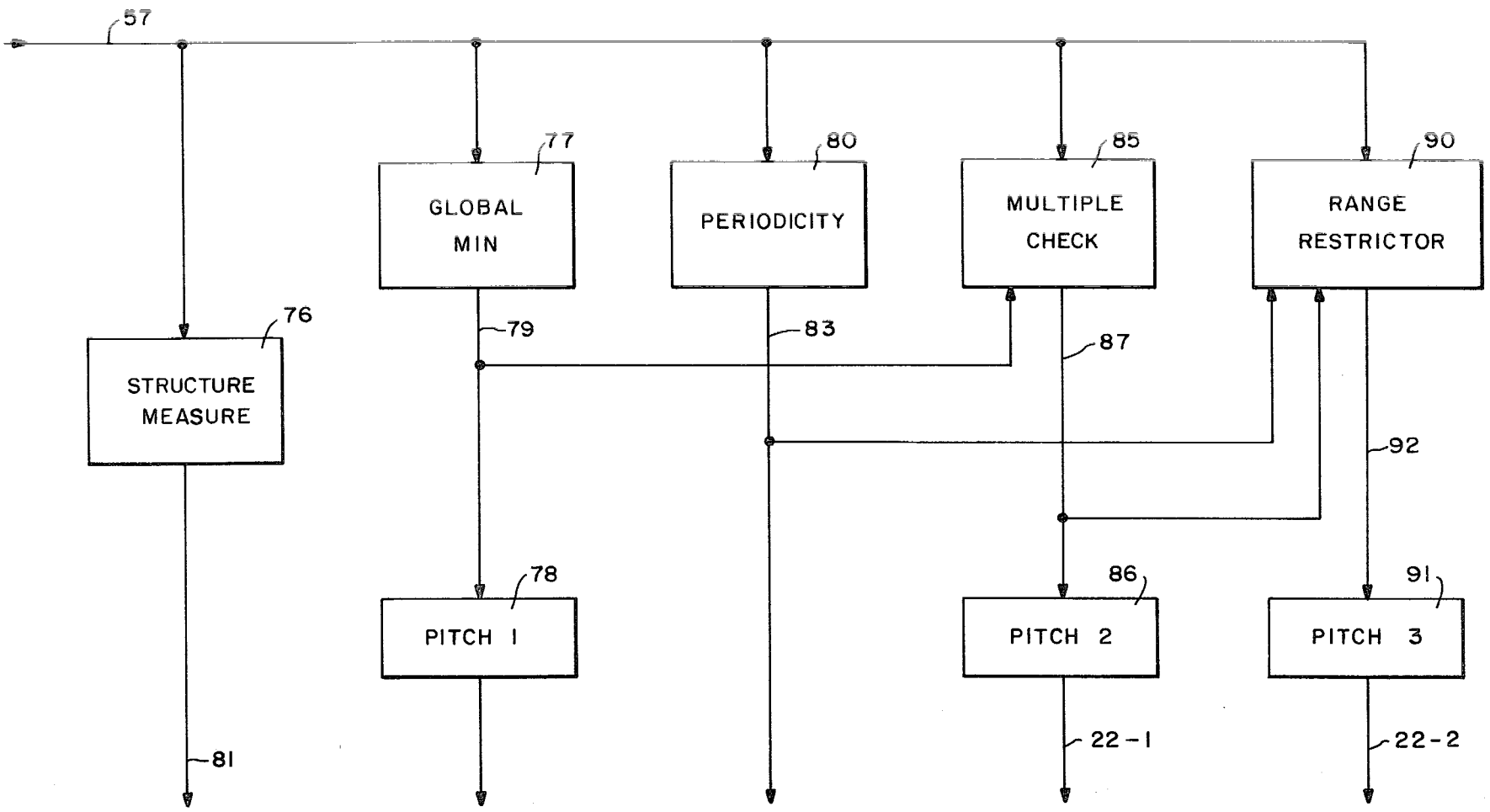
FIG. 6 depicts a portion of the pitch detector of FIG. 1.

Referring now to FIG. 6, there is depicted therein another portion of the pitch detector circuit 13 of FIG. 1.

In FIG. 6, the AMDF signal on bus 57 is input to structure means circuit 76, which provides a structure measure number on bus 81 for use by the voice detector circuit as will be described below.

The AMDF signal on bus 57 is also input to global min circuit 77, which operates to generate a first pitch signal on bus 79 which is loaded in pitch register 78. The pitch one signal can be seen on waveform 66 of FIG. 4 as point 70 and which represents the true period of the AMDF signal of FIG. 4. Points 71 and 72 are multiple minimum points and problems occur in pitch detection when the wrong minimum point is chosen as representing the true pitch of the analog speech signal.

In FIG. 5, an AMDF waveform representing a poor AMDF function is depicted and it can be seen that there are numerous minimum and maximum points which could result in improper evaluation of the true pitch.

To avoid this problem, the pitch signal generated by global min circuit 77 is connected to multiple check circuit 85, which also receives the AMDF signal via bus 57. Multiple check circuit 85 serves to verify that the correct pitch signal generated on bus 79 is the proper pitch and is not a multiple minimum such as point 71 or 72 or FIG. 4.

In order to determine the proper pitch, multiple check circuit 85 under control of the microprocessor or control circuit 27 performs an interpolation of the waveform such as 66 in FIG. 4.

For example, if the global min circuit 77 calculated that the minimum point was point 71, multiple check circuit 85 by interpolation of the discrete points on waveform 66 would calculate that the desired pitch signal occurred in fact at point 70 rather than point 71.

Hence, the multiple check circuit 85 performs an interpolation between these 160 discrete points as depicted in FIG. 4 to find the proper minimum representing the true period.

Multiple check circuit 85 generates a second pitch signal on bus 87 which is loaded into pitch register 86.

In FIG. 6, the periodicity circuit 80 receives the AMDF function on bus 57 and serves to generate a periodicity value on bus 83, which is the ratio of a maximum point such as 82 to a minimum point such as 70 in FIG. 4. It has been observed that a periodicity value of greater than an empirically determined threshold value is a useful parameter in deciding that the signal is a voice signal. The periodicity parameter is connected to the voicing detector of FIG. 7 and will be described in more detail therein.

In FIG. 6, the structure measure circuit 76 receives the AMDF function signal on 57 and operates to generate a structure measure number on bus 81. The structure measure number is important as this represents a number of extreme points of maximum and minimum values such as depicted in FIG. 4 occurring within a small range. It has been found that when the structure number measure is less than another empirically determined value, the data from the AMDF function is depicted as a glottal point event (which represents voiced speech). This is another parameter that is utilized by the voicing detector of FIG. 7.

In FIG. 6, the AMDF signal on bus 57, the periodicity signal on bus 83 and the second pitch signal on bus 87 are connected to range restrictor circuit 90. If the periodicity signal on bus 83 is above a predetermined value such as in FIG. 4, the AMDF function is considered acceptable and the second pitch signal is considered the final pitch number.

If the periodicity is below a predetermined value (such as would be the case of FIG. 5), the range over which a minimum value is to be interpolated is limited or restricted to a range of pitches centered around the average pitch within a predetermined tolerance if the periodicity is below a predetermined level whereby a third pitch is generated representing the best estimates within the restricted range. The range in one embodiment is ±30% but other variations are possible.

Figure 7:
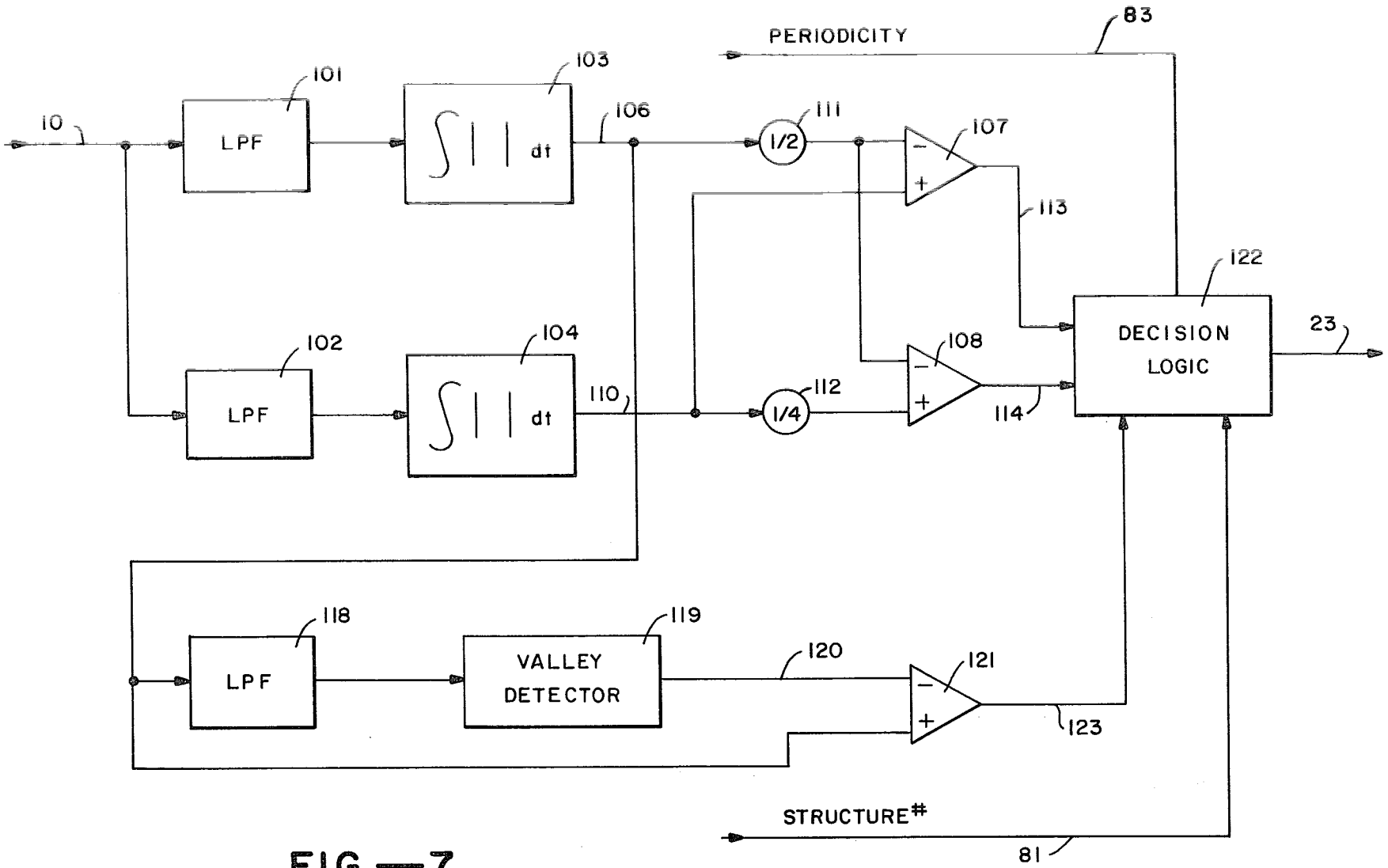
FIG. 7 depicts the voicing detector of FIG. 1.

In FIG. 7, there is depicted therein the voicing detector 14 of FIG. 1. Decision logic circuit 122 receives the periodicity signal on bus 83 and structure number on bus 81 as previously described.

The audio signal on bus 10 is passed through conventional low pass filter (LPF) 101 and high pass filter (HPF) 102, where the positive portion of the respective signals are input to low pass integrating circuit 103 and high pass integrating circuit 104, respectively.

The resulting signals on buses 106, 110, are depicted in FIGS. 8*e* and 8*d*, respectively. The integrated signals are representative of the amount of energy during the 22½ ms frame and are connected to comparators 107 and 108 in the following manner.

The low integrated signal on bus 106 is multiplied by a factor of ½ by circuit 111 and connected directly to comparators 107, 108. The high integrated signal on bus 110 is connected directly to comparator 107 and attenuated by a factor of ¼ by circuit 112 and connected to comparator 108.

If the high pass integrated signal on bus 110 is greater than one half of the low pass integrated signal, a voicing function signal is generated on bus 113. Otherwise, if one half the low pass integrated signal is greater than the high pass integrated signal, an unvoicing function is generated on bus 113.

Also, if one half of the low integrated signal is less than one fourth of the high integrated signal, a weak voicing function is indicated on bus 114. Otherwise, if one fourth of the high integrated signal is greater than one half of the low integrated signal, a strong voicing function is indicated on bus 114. Buses 113 and 114 are connected to decision logic 122, the operation of which will be described below.

The low integration signal on bus 106 is also connected to low pass filter 118 and valley detector circuit 119. Valley detector circuit 119, a standard peak detector circuit, generates the signal as depicted in FIG. 8*f* in a well known manner on bus 120, which represents the background noise measurement or level of the audio speech signal. If the low integrated signal on bus 106 is greater than the background noise level on bus 120, a power presence signal on bus 123 is generated, indicating that something such as voice is present.

The decision logic 122 receives the various parameters and serves to generate a voicing or unvoicing decision on bus 23 in the following manner.

If the signal on bus 123 is false a decision is made that the signal is unvoiced. If a strongly voice signal 7 is received on bus 113 and 114, a voice signal is generated on bus 23. If the periodicity number on bus 83 is greater than a predetermined threshold, a voice function is generated on bus 23. If the structure number on bus 81 is less than another predetermined value, a voiced function is generated on bus 23. If a weak voice on bus 114 and a predetermined periodicity value is present on bus 83, a voiced function is generated on bus 23. Otherwise, an unvoiced function is generated on bus 23 in all other respects.

Referring now to FIG. 8, a portion of a typical speech signal is depicted in FIG. 8*a*.

FIG. 8*b* depicts the multiframe format of 22½ ms/frame and the AMDF function for FIG. 8*a* is shown in FIG. 8*c*.

What is claimed is:

1. In a digital communication system operating in a multiframe format, a speech digitizer comprising:

analyzer means connected to receive an analog speech waveform, said analyzer means including power and filter coefficient means responsive to said waveform for generating in digital format variable filter coefficient and power paramaters representative of said waveform, pitch detector means responsive to said waveform for generating a digital pitch parameter substantially representing the fundamental periodicity of said waveform, said pitch detector means including automatic gain control means for stabilizing said speech waveform, converter means for converting said analog waveform to a digital format in a predetermined time frame, means for generating a digital signal representing an absolute magnitude difference function, said digital signal having a predetermined number of samples representing the variations in the pitch of said analog waveform and having a pattern of recurring maximum and minimum points over the frequency spectra, means for generating a first pitch signal representing the fundamental pitch of said sampled signal, periodicity means for generating a periodicity signal representing the ratio of one of said minimum and one of said maximum points, multiple check means connected to receive said digital signal and said first pitch signal for generating a second pitch signal when one of said multiple signals is lower than the first pitch signal by interpolating over successive ones of said samples to generate said second pitch signal, range restrictor means connected to receive said digital signal, said periodicity signal and said second pitch signal for restricting the range of said pitch signal to a range of pitches within a predetermined tolerance if the average pitch of said periodicity signal is below a predetermined level whereby a third pitch signal is generated representing the best estimate within the restricted range, and means for determining the number of extreme maximum and minimum points within a predetermined range of said absolute magnitude difference function thereby generating a structure number signal representing a voiced event when the number of extreme points is less than a predetermined number, voice detector means responsive to said waveform for generating a digital voicing parameter representing whether said speech waveform is voiced or unvoiced, multiplexer means for multiplexing said parameters into a digital serial data stream in said multiframe format where selected ones of the frames in said multiframe format occur as a synchronization frame, synchronization means for providing a digital synchronization code whereby said multiplexer multiplexes said synchronization code into a portion of said synchronization frame, first signaling interface means for connecting signaling information to another portion of said synchronization frame, means for transmitting said digital serial stream, synthesizer means connected to receive said digital serial stream for generating a second analog waveform representative of said first analog waveform, said synthesizer means including demultiplexer means for demultiplexing the transmitted parameters, the synchronization code, and the signaling information, second signaling interface means connected to receive the demultiplexed transmitted signaling information, periodic generator means for generating a digital periodic component signal representative of a pitch pulse signal and aperiodic generator means for generating a digital aperiodic signal representative of a random noise signal, mixer means connected to receive said component signals for mixing said component signals thereby forming a driving function signal, and filter means connected to receive said driving function signal for generating said second analog signal thereby representing said first analog signal.

2. A digitizer as in claim 1 wherein said voice detector means includes:

low pass detection and integration means for generating a low pass integrated signal representing the energy in a low frequency band of said waveform, high pass detection and integration means for generating a high pass integrated signal representing the energy in a high pass band of said waveform, first comparator means for generating a voicing function signal when the ratio of said low pass signal to said high pass signal exceeds a first predetermined threshold, second comparator means for generating a strong voicing function signal only when the ratio of said low pass signal to said high pass signal exceeds a second predetermined threshold, and for generating a weak voicing signal when said ratio is less than said second predetermined threshold, third comparator means for comparing said low pass integrated signal with a filtered noise level signal of said low pass integrated signal representing background noise thereby forming a power present signal when said low pass integrated signal exceeds said noise level signal, and decision logic means for generating said voicing parameter in response to said strong voice signal, to said structure signal, to said periodicity signal, or to said weak voice and periodicity signal.

3. In a digital communication system operating in a multiframe format, a speech digitizer comprising:

analyzer means connected to receive an analog speech waveform, said analyzer means including power and filter coefficient means responsive to said waveform for generating in digital format variable filter coefficient and power parameters representative of said waveform, pitch detector means responsive to said waveform for generating a digital pitch parameter substantially representing the fundamental periodicity of said waveform, said pitch detector means including;

automatic gain control means for stabilizing said waveform, converter means for converting said analog waveform into a digital format in a predetermined time frame, function means for generating a digital signal representing an absolute magnitude difference function, said digital signal having a predetermined number of samples representing the variations in the pitch of said analog waveform and having a pattern of recurring maximum and minimum points over the pitch range, means for generating a first digital pitch signal representing the fundamental pitch of said waveform, periodicity means for generating a periodicity signal representing the ratio of one of said minimum and one of said maximum points, multiple check means connected to receive said digital signal and said first pitch signal for generating a second pitch signal when one of said multiple signals is lower than said first pitch signal by interpolating over successive ones of said samples to generate said second pitch signal, and range restrictor means connected to receive said digital signal, said periodicity signal, and said second pitch signal for restricting the range of said pitch signal to a range of pitches within a predetermined tolerance if the average pitch of said periodicity signal is below a predetermined level whereby a third pitch signal is generated representing the best estimate within the restricted range, voice detector means responsive to said waveform for generating a digital voicing parameter representing whether said speech waveform is voiced or unvoiced, multiplexer means for multiplexing said parameters into a digital serial data stream in said multiframe format where selected ones of the frames in said multiframe format occur as a synchronization frame, synchronization means for providing a digital synchronization code whereby said multiplexer multiplexes said synchronization code into a portion of said synchronization frame, first signaling interface means for connecting signaling information to another portion of said synchronization frame, means for transmitting said digital serial stream where said serial stream includes during said synchronization frame said synchronization code in one portion and said signaling information in said other portion, synthesizer means connected to receive said digital stream for generating a second analog waveform representative of said analog waveform, said synthesizer means including demultiplexer means for demultiplexing the transmitted parameters, the synchronization code, and the signaling information, second signaling interface means connected to receive the demultiplexed transmitted signaling information, periodic generator means for generating a periodic component signal representative of a pitch pulse signal and aperiodic generator means for generating an aperiodic signal representative of a random noise signal, mixer means connected to receive said component signals for mixing said component signals thereby forming a driving function signal, and filter means connected to receive said driving function signal for generating said second analog waveform thereby representing said first analog waveform.

4. A digitizer as in claim 3 further including means for determining the number of extreme maximum and minimum points within a predetermined range of said absolute magnitude difference function thereby generating a structure number signal representing a voiced event when the number of extreme points is less than a predetermined number.

5. A digitizer as in claim 3 wherein said voice detector means includes:

low pass detection and integration means for generating a low pass integrated signal representing the energy in a low frequency band of said speech waveform, high pass detection and integration means for generating a high pass integration signal representing the energy in a high pass band of said speech waveform, and first comparator means for generating a voicing function signal when the ratio of said low signal to said high pass signal exceeds a first predetermined threshold, second comparator means for generating a strong voicing function signal only when the ratio of said low pass signal to said high pass signal exceeds a second predetermined threshold and for generating a weak voicing signal when said ratio is less than or equal to said second predetermined threshold.

6. A digitizer as in claim 5 further including third comparator means for comparing said low pass integrated signal with a filtered noise level signal of said low pass integrated signal representing background noise thereby forming a power present signal when said low pass integrated signal exceeds said noise level signal.

7. A digitizer as in claim 6 further including:

decision logic means for generating said voicing parameter in response to said strong voice signal, to said structure signal, to said periodicity signal or to said weak voice and said periodicity signal.

8. In a digital communication system operating in a multiframe format, a pitch detector comprising:

converter means connected to receive an analog speech waveform for converting said waveform to a digital format in a predetermined time frame corresponding to said multiframe format, means for generating a digital signal representing absolute magnitude difference function, said digital signal having a predetermined number of samples representing variations in the pitch of said waveform and having a pattern of recurring maximum and minimum points over the pitch period, means for generating a first digital pitch signal representing the fundamental pitch of said waveform, multiple check means connected to receive said digital signal and said first pitch signal for generating a second digital pitch signal when one of said recurring minimum points is lower than the first pitch signal by interpolating over successive ones of said samples of said digital signal to generate said second pitch signal thereby representing the fundamental pitch of said waveform, periodicity means for generating a periodicity signal representing the ratio of one of said minimum points and one of said maximum points, and range restrictor means connected to receive said digital signal, said periodicity signal, and said second pitch signal for generating a third pitch signal representing the restriction of the range of said first pitch signal to a range of pitches within a predetermined tolerance of the average pitch if said periodicity signal is below a predetermined level.

9. In a digital communication system operating in a multiframe format, a voicing detector connected to receive an analog speech waveform comprising:

low pass detection and integration means for generating a low pass integrated signal representing the energy in a low frequency band of said waveform, high pass detection and integration means for generating a high pass integrated signal representing the energy in a high pass band of said waveform, first comparator means for generating a voicing function signal when the ratio of said low pass signal to said high pass signal exceeds a first predetermined threshold, second comparator means for generating a strong voicing function signal only when the ratio of said low pass signal to said high pass signal exceeds a second predetermined threshold and for generating a weak voicing signal when said ratio is less than or equal to said second threshold, third comparator means for comparing said low pass integrated signal with a filtered noise level signal of said low pass integrated signal representing background noise thereby forming a power present signal when said low pass integrated signal exceeds the noise level signal, means for determining the number of extreme maximum and minimum points occurring within a predetermined range in an absolute magnitude difference function level representing said waveform within a predetermined range thereby generating a structure number signal representing a voiced event when the number of extreme points is less than a predetermined number, and decision logic means for generating said voicing parameter in response to said strong voice signal, to said structure signal, to said periodicity signal, or to said weak voicing and said periodicity signal.

10. In a speech digitizer for use in a digital communication system operating in a multiframe format, the method comprising the steps of:

generating in digital format in response to an analog speech waveform variable filter coefficient and power parameters representative of said waveform, generating a digital pitch parameter substantially representing the fundamental periodicity of said waveform, generating a digital voicing parameter representing whether said speech waveform is voiced or unvoiced, generating a digital signal representing an absolute magnitude difference function, said digital signal having a predetermined number of samples representing the variations in the pitch of said analog waveform and having a pattern of recurring maximum and minimum points over the frequency spectra, generating a first digital pitch signal representing the fundamental pitch of said sampled signal, generating a periodicity digital signal representing the ratio of one of said minimum and one of said maximum points, generating a second digital pitch signal when one of said recurring minimum points is lower than the first pitch signal by interpolating over successive ones of said digital signal to generate said second pitch signal, restricting the range of said pitch signal to a range of pitches within a predetermined tolerance of the average pitch if said periodicity signal is below a predetermined level whereby a third digital pitch signal is generated representing the best estimate with the restricted range, determining the number of extreme maximum and minimum points within a predetermined range of said difference function thereby generating a structure number signal representing a voiced event when the number of extreme points is less than a predetermined number, multiplexing said parameters into a digital serial data stream in said multiframe format where selected ones of the frames in said multiframe format occur as a synchronization frame, providing a synchronization code whereby said code is multiplexed into a portion of said synchronization frame, connecting signaling information to another portion of said synchronization frame, transmitting said digital serial stream, demultiplexing the transmitted parameters, the synchronization code, and the signaling information, receiving the demultiplexed transmitted signaling information, generating a periodic component signal representative of a random noise signal, mixing said component signals thereby forming a driving function signal, and generating a second analog signal thereby representing said first analog signal in response to said driving function signal.

11. The method of claim 10 further including the steps of:

generating a low pass integrated signal representing the energy in a low frequency band of the speech waveform, generating a high pass integrated signal representing the energy in a high pass band of the speech waveform, generating a voicing function signal when the ratio of said low pass signal to said high pass signal exceeds a first predetermined threshold, generating a strong voicing function signal only when the ratio of said low pass signal to said high pass signal exceeds a second predetermined threshold, generating a weak voicing signal when said ratio is less than or equal to said second threshold, comparing said low pass integrated signal with a filtered noise level signal representing background noise thereby forming a power present signal when said low pass signal exceeds said noise level signal, and generating said voicing parameter in response to said strong voice signal, to said structure signal, to said periodicity signal, or to said weak voice and said periodicity signal.

12. In a pitch detector for use in a digital communication system operating in a multiframe format, the method comprising the steps of:

converting an analog speech waveform to a digital format in a predetermined time frame corresponding to said multiframe format, generating a digital signal representing an absolute magnitude difference function of said waveform, said digital signal having a predetermined number of samples representing the variations in the pitch of said waveform and having a pattern of recurring maximum and minimum points over the pitch period, generating a first digital pitch signal representing the fundamental pitch of said waveform, generating a second pitch signal when one of said multiple signals is lower than the first pitch signal by interpolating over successive ones of said samples of said digital signal to generate said second pitch signal thereby representing the fundamental pitch of said waveform, and determining the number of extreme maximum and minimum points occurring within a predetermined range in an absolute magnitude different function signal representing said waveform thereby generating a structure number signal representing a voiced event when the number of extreme points is less than a predetermined number.

13. The method of claim 12 further comprising the steps of:

generating an average digital periodicity signal representing the ratio of one of said maximum points and one of said minimum points, and restricting the range of said first pitch signal to a range of pitches within a predetermined tolerance of the average pitch if said periodicity signal is below a predetermined level.

14. In a voicing detector connected to receive an analog speech waveform for use in a digital communication system operating in a multiframe format, the method comprising the steps of:

generating a low pass integrated signal representing the energy in a low frequency band of said waveform, generating a high pass integrated signal representing the energy in a high pass band of said waveform, generating a voicing function signal when the ratio of said low pass signal to said high pass signal exceeds a first predetermined threshold, generating a strong voicing function signal only when the ratio of said low pass signal to said high pass signal exceeds a second predetermined threshold, generating a weak voicing signal if said ratio is less than or equal to said second threshold, comparing said integrated low signal with a filtered noise level signal representing background noise thereby forming a power present signal when the low pass integrated signal exceeds the noise level signal, determining the number of extreme maximum and minimum points occurring within a predetermined range in an absolute magnitude difference function signal representing said waveform thereby generating a structure number signal representing a voiced event when the number of extreme points is less than a predetermined number, and generating said voicing parameter in response to said strong voice signal, to said structure signal, to said periodicity signal, or to said weak voicing and said periodicity signal.

* * * * *